United States Patent [19]

Isoard

[11] 4,291,842

[45] Sep. 29, 1981

[54] SPINDLE FOR WINDING TEXTILE YARNS

[75] Inventor: Bernard Isoard, Ecully, France

[73] Assignee: Rhone-Poulenc-Textile, Paris, France

[21] Appl. No.: 84,828

[22] Filed: Oct. 15, 1979

[30] Foreign Application Priority Data

Oct. 13, 1978 [FR] France ..... 78 29476

[51] Int. Cl.[3] ..... B65H 54/54

[52] U.S. Cl. ..... 242/46.5

[58] Field of Search ..... 242/46.5, 46.2, 46.3, 242/46.4, 46.6, 72 R, 68.1, 68.2, 68.3

[56] References Cited

U.S. PATENT DOCUMENTS

| | | | |
|---|---|---|---|
| 2,231,122 | 2/1941 | Houck | 242/46.5 |
| 3,000,585 | 9/1961 | Sokal | 242/72 |
| 3,052,420 | 9/1962 | Roberts | 242/46.3 |
| 3,169,718 | 2/1965 | Smith et al. | 424/46.5 |
| 3,268,180 | 8/1966 | Berkebile | 242/46.5 |
| 3,387,799 | 6/1968 | Wilson | 242/72 R |
| 3,471,095 | 10/1969 | Ewing | 242/46.5 |
| 3,593,934 | 7/1971 | Conrad et al. | 242/46.5 |
| 3,792,868 | 2/1974 | Flagg | 242/72 R X |
| 3,815,836 | 6/1974 | Munnekehoff et al. | 242/46.4 |
| 4,023,742 | 5/1977 | Owens et al. | 242/46.4 X |

FOREIGN PATENT DOCUMENTS

| | | | |
|---|---|---|---|
| 891964 | 12/1943 | France | 242/46.5 |

*Primary Examiner*—Stanley N. Gilreath

*Attorney, Agent, or Firm*—Sherman & Shalloway

[57] ABSTRACT

A spindle intended to support on the inside thereof and drive in rotation at least one winding support for winding textile yarns. The spindle has at least one gripping element made up of at least two flyweights, able to come in contact with the inside surface of the winding support and develop, under the effect of centrifugal force, a radial thrust assuring its gripping. It applies to winding of textile yarns, particularly chemical yarns, at high speeds of 3,000 to 7,000 m/min and more.

4 Claims, 3 Drawing Figures

SPINDLE FOR WINDING TEXTILE YARNS

This invention relates to a winding spindle intended to support and drive in rotation at least one support on which a textile yarn is to be wound.

It relates more particularly to a spindle for winding yarn at high speed. By "high speed" is meant speeds on the order of 20,000 to 40,000 rpm and more and corresponding to winding speeds greater than 3,000 meters/-minute and more, and able to go up to 6,000 to 7,000 meters/minute and more.

On spindles known so far, gripping and locking of the support is performed by various means. There are mechanical means such as balls arranged circumferentially and radially mobile in inclined faces or annular springs radially expansible. But these locking means and their control comprise numerous parts which causes dynamic balancing difficulties and requires high precision machining which is costly without giving complete satisfaction at high speed.

There are pneumatic means: membrane inflatable by a fluid under pressure. But in case of a fluid breakdown, there is a loosening of the spindle and yarn support which, at high speed, constitutes a real danger.

According to French Pat. No. 2,245,205 of the applicant, gripping means are known made up of a tubular sleeve of elastic material radially compressible under the action of a vacuum which can be created in a chamber adjacent to the sleeve. In the absence of the vacuum in the chamber, the yarn support is held by the radial pressure that the sleeve exerts against the inside surface of the support. When a vacuum is created in the chamber, the sleeve is radially compressed, thus reducing the diameter and permitting the placement and removal of the yarn support.

Further, the spindle comprises a centrifugal centering means made up of radially mobile flyweights. In rotation, these flyweights to which are applied centrifugal inertia forces, constitute a rigid mechanical centering element opposing the bending of the tube; gripping of the yarn support is assured by a tubular sleeve. The above spindle provides complete satisfaction regardless of the speed of rotation. However, its practical embodiment, particularly at the level of the fluid tightness of the vacuum passage means, is quite complex; this complexity causing a high cost.

From U.S. Pat. No. 3,471,095 it is also known to use a mandrel to support a tube for winding textile yarn. The mandrel is provided with elastic rings capable of radial expansion under the action of centrifugal force, to assure holding of the tube. However, the design and mounting of the rings are quite complex because the rings must also assure holding of the tube during stops or slow speeds and its centering regardless of the speed.

According to British Pat. No. 915,831 and its corresponding U.S. Pat. No. 3,000,585 an expansible mandrel is known comprising on its periphery a series of regularly distributed longitudinal rods, constituting flyweights which, under the effect of centrifugal force, are pressed against the inside surface of the yarn support, assuring its gripping.

This invention proposes to provide a winding spindle, simple to manufacture assuring an improved gripping of the yarn support, in particular when the latter is of a relatively soft material such as cardboard or plastic.

According to the present invention, a winding spindle intended to support and drive in rotation at least one support on which a textile yarn is to be wound, includes at least one rotary spindle body and at least one gripping means for gripping the winding support, mounted on the spindle body and made up of at least two flyweights regularly and uniformly distributed around the spindle body, radially mobile, capable of coming at least in contact with the inside surface of the support and developing under the effect of centrifugal force a radial thrust assuring the gripping of the winding support wherein a portion of the outside surface of each of the flyweights is in the shape of a pointed projection able to penetrate into the wall of the support when the spindle is in rotation.

Most usually, the winding support is made up of a relatively soft material such as cardboard or plastic. Penetration of the pointed projections into the winding support makes it possible to perfect its holding in the axial and radial directions.

Advantageously, the gripping means comprises three flyweights that can, in cross section, each envelope an angle of 120°.

The flyweights are preferably of metal and are elastically connected in the radial direction to the spindle body by springs. Their weight is calculated so that their action remains effective from the beginning to the end of the winding, it being understood that the spindle can be used in a process of constant linear winding in which as the winding becomes thicker, the angular speed decreases and consequently also the centrifugal force.

According to a preferred embodiment, the outside surface of the flyweights present flat parts; the intersection of two successive flat parts constituting an edge extending approximately along a generatrix of the winding support. In cross section, the periphery of the gripping means presents the shape of a polygon. The pointed projections are located on the edges and at rest the summit of the projections is inscribed in a circle whose diameter is slightly greater than the inside diameter of the winding support, this excess diameter being some tenths of millimeters for winding supports with an inside diameter of 50 to 100 mm. The pointed projections exhibit a triangular, trapezoidal or rectangular profile determined as a function of the ease of introduction and removal of the winding support, taking into account the excess of the above diameter.

Depending on its length and the number of winding supports that it is supposed to receive, the spindle can include one or more gripping means. In particular, to receive several winding supports, the spindle comprises several gripping means. Advantageously, their distribution is determined to be able to hold on the same spindle a variable number of winding supports of different length, for example, two long supports, three medium supports, four short supports; the supports end to end occupying almost the entire length of the spindle.

The spindle according to this invention is suitable for winding of textile yarn at speeds of 3,000 to 7,000 m/min and more, with formation of windings whose final diameter can reach 360 mm on supports with an outside diameter between 60 and more than 100 mm.

The invention will be better understood from the following detailed description of illustrative and non-limiting embodiments and accompanying drawings in which.

Figure 1:
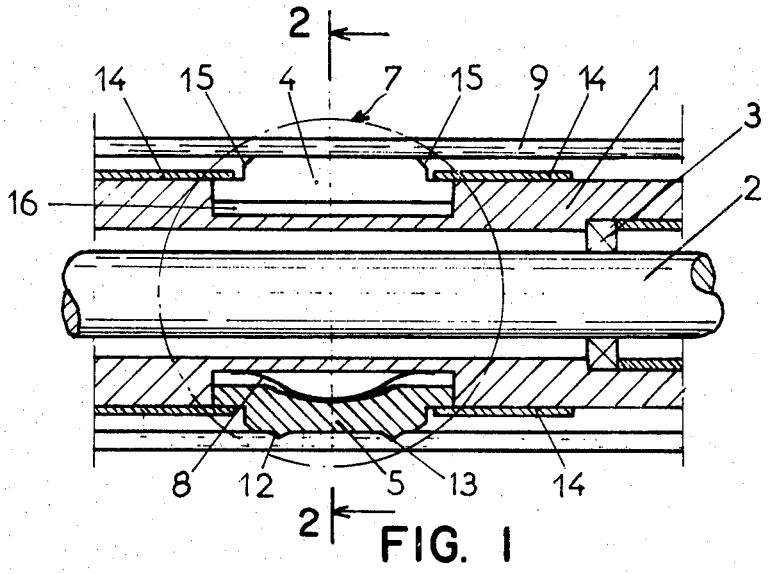
FIG. 1 is a longitudinal partial view, in section, of the spindle showing a gripping means.
Figure 2:
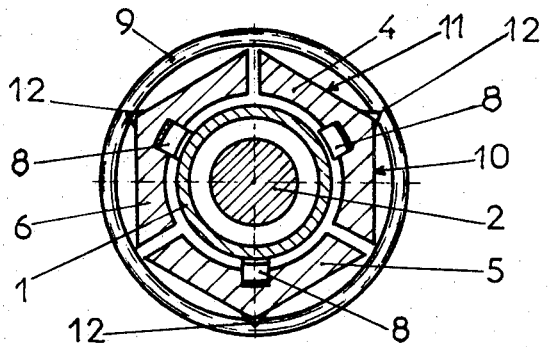
FIG. 2 is a view in cross section along line 2—2 of the spindle according to FIG. 1.

The spindle according to FIGS. 1 and 2 includes spindle body 1 mounted to rotate on a stationary shaft 2 by rollers such as 3. Rotation of spindle body 1 can be assured by a gas fluid turbine, for example, described in French Pat. Nos. 2,238,382 and 2,245,205. Around the spindle body 1 are regularly distributed three flyweights 4, 5 and 6 each enveloping the body over about 120°. Each of the flyweights fits in a recess 16 of the spindle body and are elastically connected to the spindle body 1 by springs such as 8. Under the influence of springs 8, the flyweights strike radially on rings 14 which are connected to spindle body 1. Springs 8 are intended to give a certain cohesion to the group of three flyweights but they have only a slight role in gripping winding tube 9 mounted on the spindle. The peripheral surface of each flyweight is made up of two flat parts 10 and 11 whose intersection forms an edge parallel to the axis of the spindle (in other words, extending roughly along a generatrix of the inside surface of tube 9). Thereby, the outside profile of the gripping element exhibits roughly the shape of a hexagon inscribed in a circle whose diameter is roughly equal to the inside diameter of tube 9. For each flyweight, on the edge of intersection of flat parts 10 and 11, there are provided two projections 12 and 13 which advantageously are shaped from the main body of the flyweight. The profile and dimensions of the projections are designed by taking into account ease of introduction and removal of tube 9. Preferred shapes include trapezoidal, triangular or rectangular profiles. The height of projection is slight, on the order of some tenths of millimeters. To facilitate placement of the tubes, the flyweights are advantageously beveled at 15.

In operation, the gripping means 7 functions as follows: During stopping, the flyweights, under the influence of springs 8, strike against rings 14. Tube or tubes 9 are put in place, which causes a slight radial compression of the flyweights. The spindle is then put into rotation. Under the influence of centrifugal force, the flyweights have a tendency to move away radially from body 1, but quickly strike rings 14. Points 12 and 13 penetrate slightly into the inside wall of the tube, marking the latter with their imprint. During the entire time of rotation of the spindle, under the effect of centrifugal force, the flyweights rest against the wall of tube 9 holding it. Points 12 and 13 assure the lateral holding of tube 9. As the winding grows thicker, the angular speed diminishes, but considering the winding speed (3,000 to 7,000 meters/minute) and the final diameter of the winding, it remains enough to assure holding until the end of the winding. When the winding is finished, the rotation of the spindle is stopped, and the effect of the centrifugal force ceases. Given the slight penetration of the points and their adapted profile, the tube can be removed from the spindle without difficulty.

Figure 3:
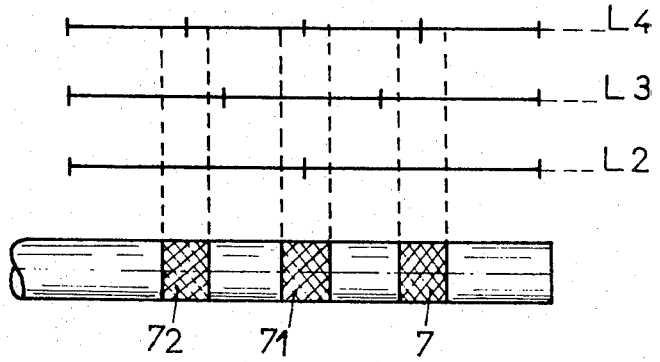
FIG. 3 is a diagrammatic longitudinal view of a spindle according to the invention, provided with three gripping elements.

FIG. 3 diagrammatically represents a spindle provided with three identical gripping means: 7, 71, 72 judiciously distributed over its length. The spindle is thus able to receive, end to end, two, three or four tubes whose lengths are schematically represented on lines L2, L3 and L4. The construction of such a spindle of universal nature does not pose any particular problem, given the simplicity of design and embodiment of the gripping means.

Obviously the invention can exhibit variants of embodiment of the gripping means. These variants can relate to the number of flyweights, their outside shape, the number and shape of the points, etc.

For example, the group of flyweights, considered in cross section, can envelope not all the periphery of the spindle body but only sectors of it; i.e., regularly distributed sectors.

Besides its simplicity and ease of embodiment, the spindle exhibits all the qualities required for high speed winding:

good holding of the yarn support for all speeds: from start to finish of the winding:

good longitudinal holding due to the pointed projections;

self-centering nature by the very design of the spindle, which makes it possible to compensate the lack of balance that can be encountered at the beginning of winding on the empty or slightly covered yarn support;

ease of placement and removal of the yarn support.

The invention applies to winding of yarns at high speeds: 3,000 to 7,000 m/min and more, in particular winding of yarns of synthetic material, however, it is suitable for winding yarns of all counts and natures.

What is claimed is:

1. A winding spindle adapted to support and drive in rotation therewith at least one winding support on which a textile yarn is to be wound, comprising at least one rotary spindle body and at least one gripping means for gripping the winding support mounted on the spindle body, wherein the gripping means comprises at least two flyweights regularly distributed around the spindle body, radially mobile and able to come in contact at least with the inside surface of the winding support and to develop, under the effect of centrifugal force, a radial thrust assuring its gripping; wherein the outside surface of each flyweight presents flat parts, the intersection of two successive flat parts constituting an edge extending roughly along a generatrix of the inside of the support, and wherein the outside surface of the flyweights includes at least one pointed projection, each pointed projection being located on said edge, the height of said pointed projections being on the order of tenths of a millimeter, and the profile of said projections being trapezoidal or triangular in the longitudinal direction, said pointed projection being able to penetrate into the wall of the support when the spindle is rotating, thereby improving the holding of the support in the radial rotation and in the axial directions, and allowing the winding support to be easily disengaged from the gripping means and spindle body when the latter is at rest.

2. The winding spindle according to claim 1 wherein the gripping means includes three flyweights, wherein each of said flyweights has two pointed projections, and the outside cross-sectional profile of the flyweights is hexagonal.

3. The winding spindle according to claim 1 wherein three identical gripping means are distributed over its length to assure the holding of one, two, three or four tubes of different lengths.

4. The winding spindle according to claim 2 wherein three identical gripping means are distributed over its length to assure holding of one, two, three or four tubes of different lengths.

* * * * *